US006569222B2

(12) United States Patent
McCormick

(10) Patent No.: US 6,569,222 B2
(45) Date of Patent: May 27, 2003

(54) CONTINUOUS SINGLE STAGE PROCESS FOR THE PRODUCTION OF MOLYBDENUM METAL

(75) Inventor: Edward V. McCormick, Churchville, NY (US)

(73) Assignee: Harper International Corporation, Lancaster, NY (US)

( * ) Notice: Subject to any disclaimer, the term of this patent is extended or adjusted under 35 U.S.C. 154(b) by 0 days.

(21) Appl. No.: 09/867,247

(22) Filed: May 29, 2001

(65) Prior Publication Data

US 2001/0049981 A1 Dec. 13, 2001

Related U.S. Application Data

(60) Provisional application No. 60/210,501, filed on Jun. 9, 2000.

(51) Int. Cl.[7] ..... B22F 9/20
(52) U.S. Cl. ..... 75/369; 75/623
(58) Field of Search ..... 75/363, 369, 623

(56) References Cited

U.S. PATENT DOCUMENTS 4,045,216 A * 8/1977 Meyer et al. ..... 75/623
4,595,412 A * 6/1986 Brunelli et al. ..... 75/363
5,330,557 A * 7/1994 May ..... 75/623

* cited by examiner

*Primary Examiner*—George Wyszomierski
(74) *Attorney, Agent, or Firm*—Christopher E. Blank; Jaeckle Fleischmann & Mugel, LLP

(57) ABSTRACT

Molybdenum trioxide or ammonium dimolybdate is reduced to molybdenum metal as it passes through an atmosphere of hydrogen in a multi-zoned thermally profiled rotating tube furnace.

8 Claims, No Drawings

CONTINUOUS SINGLE STAGE PROCESS FOR THE PRODUCTION OF MOLYBDENUM METAL

This application claims the benefit of U.S. Provisional Application No. 60/210,501, filed Jun. 9, 2000.

BACKGROUND OF THE INVENTION

1. Field of the Invention

This invention relates to a process for the preparation of molybdenum metal, and, in particular, to a continuous single stage process for the production of molybdenum metal from molybdenum trioxide or a molybdate salt.

2. Prior Art

The production of elemental molybdenum metal is typically accomplished in at least two stages or steps, each involving different equipment and conditions. In the first stage, ammonium dimolybdate, or molybdenum trioxide, is reduced to molybdenum dioxide. (In some prior art processes, ammonium molybdate is first converted to molybdenum trioxide and the latter is then reduced in a second step to molybdenum dioxide.) The reduction of the starting material to molybdenum dioxide is typically carried out in a rotary tube furnace. The second reaction, that is, the reduction of the dioxide to elemental metal is carried out at a higher temperature and is typically carried out in a stationary tube furnace. Both reactions are carried out in a reducing atmosphere, such as, hydrogen or dissociated ammonia.

U.S. Pat. No. 2,987,392 to Suprio discloses a process for producing molybdenum metal by reduction of molybdenum trioxide at elevated temperatures, in a hydrogen atmosphere, and in the presence of a solid reducing agent consisting of hexamine or a hexamine derivative. The process is carried out by placing a mixture of molybdenum trioxide and the hexamine reducing agent in boats and moving the boats through a tube furnace at temperatures ranging from 400°–1000° C.

U.S. Pat. No. 4,595,412 to Brunelli et al discloses the reduction of an ammonium molybdate salt to molybdenum dioxide in a hydrogen atmosphere at a temperature of about 700° C. in a calciner and subsequently reducing the dioxide to metal in a muffle furnace in a hydrogen atmosphere at a temperature of about 950° C.

U.S. Pat. No. 5,125,964 to Buerkel et al discloses a fluidized bed process for the preparation of tungsten metal powder by the controlled reduction of tungsten oxides in the presence of a mixture of hydrogen and water vapor at temperatures in the range of about 650° to 1000° C. The particles of tungsten oxide are produced by heating particles of ammonium paratungstate.

U.S. Pat. No. 5,125,965 to Sebenik discloses a fluidized bed process wherein molybdenum oxide is reduced to molybdenum metal. An oxidant is introduced into the fluidized bed during the reducing process in order to substantially prevent or reverse the agglomeration of the particles.

U.S. Pat. No. 5,734,960 to Patrician et al. discloses a process for producing potassium and silicon doped molybdenum by mixing aqueous solutions of ammonium molybdate and potassium silicate and heating and then crystallizing ammonium dimolybdate doped with potassium and silicon from the mixture. The crystals are then calcined in an atmosphere of dissociated ammonia to produce doped molybdenum dioxide which, in turn, is reduced to doped molybdenum powder.

SUMMARY OF THE INVENTION

It is an object of the present invention to provide a continuous single stage process for the production of molybdenum metal powders from molybdenum oxide reactants, by subjecting the reactants to a reducing atmosphere in a thermally profiled rotary furnace.

It is a further object to provide a continuous single stage process for the production of molybdenum metal powders from ammonium molybdate in a thermally profiled continuous rotary tube furnace.

It is a still further object to provide a continuous single stage process for the production of production of molybdenum metal by reacting ammonium molybdate or molybdenum trioxide reactants in a rotary tube furnace in an atmosphere of reducing gas wherein the reaction temperature is moderated by the use of cooling external to the furnace or by the use of excess gas, or both.

These and other objects are achieved in accordance with the present invention wherein molybdenum trioxide or ammonium molybdate is reduced to molybdenum metal as it passes through a reducing atmosphere in a multi-zoned thermally profiled rotary tube furnace. The thermal profile preferably comprises three zones. The first zone is preferably maintained at a temperature of about 400° to less than about 650° C., most preferably about 550° to about 640° C. it is preferable to maintain the first zone below the sublimation temperature of molybdenum trioxide (about 650° C.) to avoid excessive loss of material. The second zone is preferably maintained at about 800°+ or − about 100° and most preferably + or − about 20° to 50° C. The third zone is preferably maintained at about 1000°+ or − about 100°, and most preferably + or − about 20° to 50° C.

Various molybdate salts, especially ammonium molybdates, may be employed as the starting reactant, including, for example, ammonium dimolybdate, ammonium paramolybdate, ammonium octamolybdate and the like. The preferred ammonium molybdate starting material is ammonium dimolybdate.

The process is carried out in a reducing atmosphere, preferably a hydrogen bearing atmosphere such as forming gas, dissociated ammonia or hydrogen. The preferred atmosphere is hydrogen. During the process, the reducing gas is preferably passed through the furnace in a counter current direction.

The process can be carried out in any hydrogen-capable rotary tube furnace that provides an appropriate residence time and temperature requirements. A rotary tube furnace provides the best combination of heat transfer and gas-solid interaction.

During the reduction of the molybdenum trioxide or molybdate salt feedstock to molybdenum metal, the feedstock may pass through a variety of suboxide phases. In the present description, the names of only the major phases are used, for the sake of clarity. Also, for the sake of clarity, the material undergoing various stages or phases of reduction, as it passes through the rotating furnace, prior to the final reduction to molybdenum metal, may be referred to herein as "feedstock", even though its stoichiometric composition may change by reduction from the entering molybdenum trioxide or molybdate salt feedstock.

The reaction rate is moderated by controlling the thermal cycle. It is preferred, however, that the molybdenum trioxide or ammonium dimolybdate feedstock enter the furnace at a temperature low enough so that excessively rapid reduction does not occur. The feedstock may then be heated at a controlled rate to reduce it to molybdenum dioxide. During the process reduction takes place gradually and continuously and a mixture of oxides and metal may be present at any time. Typically, very little metal is present in the first zone. As the particles enter the second zone, considerable reduction occurs. Nevertheless, some sublimation of the trioxide may take place during the process, especially in the second and third zones. However, if the reducing gas is flowing in a counter current direction, sublimed trioxide will be carried back to the cooler zone, that is, the entry zone, where it may plate out as a powder on the surface of the entering feedstock particles.

The particle size of the entering feedstock may vary considerably. In general, the larger the particle size, the longer will be the residence time in the reaction zone since, when the particles are larger, the reducing gas may require a longer time to diffuse into the particles. The preferred average particle size is between about 1 and 100 microns.

The residence time in the reaction zone is also dependent on the loading. Typically, the fill volume of the furnace is about 5% and the residence time in the heated section is about an hour. The residence time may be controlled in a rotary tube furnace, in a known manner, by controlling the speed of rotation and the degree to which the tube is tilted from the horizontal.

The reaction rate must be controlled to prevent the reaction from liberating excessive heat. Excessive heat may result in the unwanted sublimation of $MoO_3$. Furthermore, additional heat generated by excessive reaction rates can result in material agglomeration, which in turn, may inhibit the diffusion of the gaseous reductant. This has presented a problem in prior art processes. In extreme cases, the large agglomerates may block the furnace and the product discharge. Moreover, excessive reaction rates may cause the material to adhere to the tube wall and may form a ring which will hinder the passage of material through the furnace and, in extreme cases, may actually close off the tube. In some prior art processes the agglomeration is controlled by addition of an oxidizing agent. However oxidizing during a reduction can present an explosion hazard. The need to oxidize during reduction is eliminated in the present process which allows the reaction rate to be moderated by controlling the thermal cycle. With temperature moderation, a more gradual reduction in the first and second zones aids in controlling the problem of agglomeration. In accordance with the present invention, control of the thermal cycle and moderation of the reaction temperature may be achieved, as needed, by adjustment of power to the heating elements as well as through the use of forced cooling, external to the tube furnace. External cooling may be achieved, for example, by blowing air or other suitable cooling gas across the outside of the furnace, as needed. Alternatively, moderation of the reaction rate and reaction temperature may be achieved through the use of additional reducing gas, for example, in amounts as high as 200–300% excess of the stoichiometric requirement or through the addition of inert gas diluent, such as nitrogen or argon, to the reducing gas.

EXAMPLE

Powdered $MoO_3$, having an average particle size of about 5–10 microns, is fed into the entrance end of a rotating tube furnace, thermally profiled to provide three temperature zones. The first or entrance zone of the furnace is maintained at about 620° C. The second or middle zone of the furnace is maintained at about 800° C. The third or exit zone is maintained at about 1000° C. The rotation of the tube and rate of feed are controlled to provide a fill volume of the furnace of about 5% and a residence time of about one hour. The feedstock particles move through the rotating tube furnace in contact with a counter-current flow of hydrogen gas. As the feedstock moves through the furnace, the $MoO_3$ is gradually and continuously reduced to $MoO_2$ and then to Molybdenum metal. Most of the reduction occurs in the second zone. Also in the second zone, some of the $MoO_3$ sublimes and the vapors are carried back with the counter-current of hydrogen, to the first zone, where it plates out on the entering particles of $MoO_3$. Molybdenum metal powder is recovered at the exit end of the furnace.

While the present invention has been described herein with reference to certain preferred embodiments, it will be understood that various modifications may be made without departing from the spirit and scope of the invention.

What is claimed is:

1. A process for the production of molybdenum metal powder from a feedstock powder selected from the group consisting of molybdenum trioxide, and ammonium molybdate salts, comprising reducing said feedstock to molybdenum metal powder by passing said feedstock through a thermally profiled rotating tube furnace in a reducing atmosphere, wherein said feedstock passes progressively through A) a first furnace zone maintained at a temperature of about 400° to 640° Celsius and the resident time of the feedstock in said first furnace zone is sufficient to allow substantial conversion of feedstock powder to molybdenum dioxide in said first furnace zone;

B) a second furnace zone maintained at a temperature of about 700° to 900° Celsius;

C) a third furnace zone maintained at a temperature of about 900° to 1100° Celsius.

2. A process according to claim 1 wherein said feedstock is ammonium dimolybdate.

3. A process according to claim 2 wherein said reducing atmosphere is hydrogen.

4. A process according to claim 3 wherein said hydrogen is passed through said rotating tube furnace in a flow counter-current to the progressive passage of said feedstock.

5. A process according to claim 1 wherein said feedstock is molybdenum trioxide.

6. A process according to claim 5 wherein said reducing atmosphere is hydrogen.

7. A process according to claim 6 wherein said hydrogen is passed through said rotating tube furnace in a flow counter-current to the progressive passage of said feedstock.

8. A process according to claim 7 wherein said hydrogen is maintained in an amount of at least about 100% excess of the stoichiometric amount required for reduction.

* * * * *